US005843338A

United States Patent [19]

Inoue et al.

[11] Patent Number: 5,843,338

[45] Date of Patent: Dec. 1, 1998

[54] WATER-SOLUBLE COMPOSITION FOR WATER-REPELLENT TREATMENTS OF ZINC AND ZINC ALLOY AND METHOD FOR WATER REPELLENT TREATMENT

[75] Inventors: Manabu Inoue; Tadahiro Ohnuma; Tomitaka Yamamoto; Go Sato, all of Tokyo, Japan

[73] Assignee: Dipsol Chemicals Co., Ltd., Tokyo, Japan

[21] Appl. No.: 734,598

[22] Filed: Oct. 22, 1996

[30] Foreign Application Priority Data

Oct. 25, 1995 [JP] Japan ..... 7-277629

[51] Int. Cl.[6] ..... C09D 129/02; C09D 133/02; C09D 145/00

[52] U.S. Cl. ..... 252/389.1; 252/389.62; 252/396; 106/172.1; 106/189.1

[58] Field of Search ..... 106/172.1, 189.1, 106/14.13; 252/389.1, 396, 389.62

[56] References Cited

U.S. PATENT DOCUMENTS

| | | | |
|---|---|---|---|
| 3,491,039 | 1/1970 | Takahashi et al. | 260/17 |
| 3,505,128 | 4/1970 | Fujii et al. | 148/6.2 |
| 3,573,236 | 3/1971 | Barlow | 260/17 |
| 3,583,876 | 6/1971 | Wennergren | 106/189 |
| 3,682,713 | 8/1972 | Ries et al. | 148/6.14 R |
| 4,973,359 | 11/1990 | Yamasoe | 106/14.13 |
| 5,157,069 | 10/1992 | Campbell | 524/500 |
| 5,158,622 | 10/1992 | Reichgott et al. | 148/247 |
| 5,252,318 | 10/1993 | Joshi et al. | 424/78.04 |
| 5,328,525 | 7/1994 | Musingo et al. | 148/247 |

FOREIGN PATENT DOCUMENTS

| | | |
|---|---|---|
| 1 145 259 | 10/1957 | France . |
| 50-156635 | 6/1974 | Japan . |
| 50-157832 | 6/1974 | Japan . |
| 56-069378 | 6/1981 | Japan . |
| 56-069379 | 6/1981 | Japan . |
| 1 027 548 | 4/1966 | United Kingdom . |

OTHER PUBLICATIONS

Database WPI, Derwent Publications, AN–81–54392D, JP–A–56 069 379, Jun. 10, 1981.

Chemical Abstracts, vol. 83, No. 10, Sep. 8, 1975, AN–83444k, Yoshiaki Suzuki, "Aftertreatment of Phosphate Coating on Zinc–Coated Steel", JP–B–49 035 494, Sep. 24, 1974.

Database WPI, Derwent Publications, AN–81–54391D, JP–A–56 069 378, Jun. 10, 1981.

Patent Abstracts of Japan, vol. 006, No. 085, May 22, 1982, JP–A–57 016175, Jan. 27, 1982.

*Primary Examiner*—Joseph K. McKane
*Assistant Examiner*—Deanna Baxam
*Attorney, Agent, or Firm*—Oblon, Spivak, McClelland, Maier & Neustadt, P.C.

[57] ABSTRACT

A composition for water-repellent treatment of zinc and zinc alloys which comprises a non-ionic polymeric compound having both hydrophilic and hydrophobic groups in the molecule, a polyacrylic acid salt and a balance of water. The composition can be used in a method for water-repellent treatment of zinc and zinc alloys which comprises the steps of immersing zinc or zinc alloys which has been subjected to a conversion treatment, then washing it with water and drying the same. The use of the water-soluble composition for water-repellent treatments permits considerable reduction of the contact area between the repellent-treated metal material and moisture which becomes a cause of corrosion under the corrosive environment in which water and oxygen coexist and this accordingly results in the improvement in the corrosion-resistance of the metal material.

7 Claims, No Drawings

WATER-SOLUBLE COMPOSITION FOR WATER-REPELLENT TREATMENTS OF ZINC AND ZINC ALLOY AND METHOD FOR WATER REPELLENT TREATMENT

BACKGROUND OF THE INVENTION

The present invention relates to a water-soluble composition for water-repellent treatment capable of imparting water repellency to zinc and zinc alloys, in particular, zinc and zinc alloys which are subjected to a conversion treatment as well as a method for water-repellent treatment of these materials.

There have widely been used the chromate treatments which make use of hexavalent chromium in order to further improve the characteristic properties of zinc and zinc alloys, in particular, zinc and zinc alloy films plated on the surface of metals such as steel. The chromate treatments permit considerable improvement of the zinc and zinc alloy-plated films in their durability, but they should in general be further subjected to a finishing treatment using chromic acid and/or application of a variety of coating compositions in order to further improve the corrosion resistance thereof. Moreover, the chromate treatment and the finishing treatment using chromic acid have a bad influence upon environment because these treatments require the use harmful hexavalent chromium. In addition, the application of a coating composition suffers from such problems that the treating processes are quite complicated and that the coating composition per se is quite expensive.

For this reason, there has been desired for the development of a novel method for treating the surface of zinc and zinc alloy-plated metals without using harmful hexavalent chromium.

SUMMARY OF THE INVENTION

Accordingly, it is an object of the present invention to provide a water-soluble composition for water-repellent treatment capable of imparting water repellency to zinc and zinc alloys through a simple method.

Another object of the present invention is to provide a method for efficiently imparting water repellency to zinc and zinc alloys.

More particularly, another object of the present invention is to improve the corrosion resistance of conversion-treated films without using hexavalent chromium.

These and other objects of the present invention will be apparent from the following description and Examples. The present invention has been completed on the basis of such a finding that the foregoing drawbacks associated with the conventional techniques can effectively be eliminated and water repellency can be imparted to zinc and zinc alloys, by simply immersing them in an aqueous solution comprising a specific polymer compound.

According to an aspect of the present invention, there is provided a water-soluble composition for water-repellent treatment of zinc and zinc alloys, which comprises a non-ionic polymeric compound carrying both hydrophilic and hydrophobic groups in the molecule.

According to another aspect of the present invention, there is provided a method for water-repellent treatment of zinc and zinc alloys which comprises the steps of immersing zinc or zinc alloys, which has been subjected to conversion treatments, in the foregoing water-soluble composition, washing them with water and then drying the same.

DESCRIPTION OF THE PREFERRED EMBODIMENTS

The present invention will hereinafter be explained in more detail.

Examples of non-ionic polymeric compounds each carrying both hydrophilic and hydrophobic groups in the molecule usable herein are polyvinyl alcohol, methyl cellulose, ethyl cellulose, hydroxymethyl cellulose, hydroxyethyl cellulose and hydroxypropyl cellulose, which may be used alone or in any combination. Preferred are polyvinyl alcohol, methyl cellulose and hydroxyethyl cellulose. The molecular weights of these non-ionic polymeric compounds are not restricted to a specific range insofar as they are soluble in water, but it is desirable to use those having a weight average molecular weight on the order of 10,000 to 160,000. In this respect, polyvinyl alcohol preferably has a degree of saponification of not more than 82 mole %, in particular, 70 to 80 mole %.

The concentration of the non-ionic polymeric compound in the aqueous solution is not also restricted to any particular range, but preferably ranges from 0.01 to 10% by weight and most preferably 0.1 to 10% by weight on the basis of the total weight of the composition.

It is preferred to further incorporate a polyacrylic acid salt, preferably an alkali metal salt of the acid into the water-soluble composition for water-repellent treatments according to the present invention. The polyacrylic acid salt may have any molecular weight in so far as they are soluble in water, but it is desirable to use those having a weight average molecular weight on the order of 250,000 to 7,000,000. The polyacrylic acid salt content of the composition is not also limited to any specific range, but desirably ranges from 0.01 to 10% by weight based on the total weight of the composition.

In addition, the water-soluble composition of the present invention may further comprise, for instance, water-soluble melamine resins and/or water-soluble acrylic resins as optional components. Moreover, the pH value of the water-soluble composition may be arbitrarily be selected, but preferably ranges from 6 to 8.

Zinc and zinc alloys to be treated according to the present invention may be zinc and zinc alloys per se as well as products obtained by forming, preferably through plating, zinc or zinc alloy films on substrates such as steel and copper substrates. Examples of the zinc alloys include those of zinc with, for instance, iron, chromium, tin, nickel, cobalt and manganese. The thickness of the zinc or zinc alloy films may arbitrarily be selected, but preferably ranges from about 1 to 25 $\mu$m.

In the present invention, it is preferred to use, as materials to be treated, zinc and zinc alloys, in particular, zinc and zinc alloy films which are subjected to conversion treatments. Examples of such conversion treatments preferably include those which use conversion treatment solutions free of hexavalent chromium such as rust proof film-forming treatments as disclosed in Japanese Patent Application Serial No. Hei 7-211585; and phosphoric acid salt-treatments as disclosed in J.P. KOKAI No. Sho 59-116383. In this respect, it is a matter of course that the present invention is also applicable to chromate-treated substances.

According to the water-repellent treatment method of the invention, zinc and zinc alloys subjected to conversion treatments are immersed in the water-soluble composition for water-repellent treatments of the present invention after washing with water or without water-washing, followed by washing with water and drying. More specifically, they are desirably immersed in the water-soluble composition at a temperature ranging from 15° to 35° C. for about 5 to 120 seconds, then washed with water at a temperature ranging from 10° to 30° C. for about 5 to 60 seconds and dried at a temperature ranging from 40° to 60° C. for about 3 to 20 minutes.

As has been discussed above in detail, the use of the water-soluble composition for water-repellent treatments according to the present invention permits considerable reduction of the contact area between the water-repellent metal material treated and moisture which becomes a cause of corrosion under the corrosive environment in which water and oxygen coexist and this accordingly results in the improvement in the corrosion-resistance of the metal material.

The composition and method according to the present invention will hereinafter be described in more detail with reference to the following non-limiting working Examples and Comparative Examples.

EXAMPLE 1

A Zn component which comprised an SPCC steel plate provided thereon with a Zn-plated film was subjected to a rust proof film-forming treatment at 25° C. for 60 seconds using a treating solution as disclosed in Japanese Patent Application Serial No. Hei 7-211585, i.e., an aqueous solution which comprised 50 g/l of 35% hydrogen peroxide, 10 g/l of potassium silicate and 10 g/l of a 20% titanium chloride solution and whose pH was adjusted to 1.6 with sulfuric acid.

The Zn component subjected to the rust proof film-forming treatment was then immersed, at 25° C. for one minute, in an aqueous solution for water-repellent treatments which had been prepared by dissolving 4 g/l of a polyvinyl alcohol having a degree of saponification ranging from 71.0 to 82.0 mole % and a degree of polymerization ranging from 1000 to 1500, then washed with water and dried at 50° C. to give a water-repellent treated Zn component.

EXAMPLE 2

The same procedures used in Example 1 except that the Zn component was subjected to a chromate treatment instead of the rust proof film-forming treatment to thus give a water repellent-treated Zn component. In this regard, the chromate treatment solution used was "Z-496" (principal components: anhydrous chromic acid, nitric acid) available from Dipsole Company and the chromate treatment was carried out at 25° C. for 20 seconds.

EXAMPLE 3

The same procedures used in Example 1 except that the Zn component was subjected to a phosphoric acid salt treatment instead of the rust proof film-forming treatment to thus give a water repellent-treated Zn component. In this regard, the solution used for the phosphoric acid salt treatment was "P-670" (principal components: phosphoric acid, nitric acid) available from Dipsole Company and the treatment was carried out at 50° C. for 20 seconds.

EXAMPLE 4

The same procedures used in Example 1 except for using, as the solution for the water-repellent treatment, an aqueous solution which was prepared by dissolving 4 g/l of a polyvinyl alcohol having a degree of saponification ranging from 71.0 to 82.0 mole % and degree of polymerization ranging from 1000 to 1500 and to which 10 g/l of sodium polyacrylate was supplemented to thus give a water repellent-treated Zn component.

EXAMPLE 5

The same procedures used in Example 1 except for using, as the solution for the water-repellent treatment, an aqueous solution which was prepared by dissolving 5 g/l of methyl cellulose to thus give a water repellent-treated Zn component.

EXAMPLE 6

The same procedures used in Example 1 except for using, as the solution for the water-repellent treatment, an aqueous solution which was prepared by dissolving 8 g/l of hydroxyethyl cellulose to thus give a water repellent-treated Zn component.

EXAMPLE 7

The same procedures used in Example 4 except that the Zn component was subjected to a chromate treatment instead of the rust proof film-forming treatment to thus give a water repellent-treated Zn component.

EXAMPLE 8

The same procedures used in Example 4 except that the Zn component was subjected to a phosphoric acid salt treatment instead of the rust proof film-forming treatment to thus give a water repellent-treated Zn component.

Comparative Example 1

The Zn component of Example 1 subjected to the rust proof film-forming treatment was used as a comparative sample without subjecting it to any water-repellent treatment.

Comparative Example 2

The Zn component of Example 2 subjected to the chromate treatment was used as a comparative sample without subjecting it to any water-repellent treatment.

Comparative Example 3

The Zn component of Example 3 subjected to the phosphoric acid salt treatment was used as a comparative sample without subjecting it to any water-repellent treatment.

The Zn components prepared in the foregoing Examples and Comparative Examples were inspected for their corrosion resistance by the following method.

Corrosion Resistance Evaluation Test

Each sample was subjected to the salt spray test in which a 5% saline was used according to JIS Z2371 to determine the time (white rust-forming time: W.R.T.) required till the white rust-gathering surface area reached 5% of the total surface area of the sample. The results thus obtained are summarized in the following Table 1.

TABLE 1

| Ex. No. | Conversion Treatment | Water Repellnt Treatment | W.R.T. (hr.) |
|---|---|---|---|
| 1 | rust proof film | polyvinyl alcohol | 408 |
| 2 | chromate | polyvinyl alcohol | 384 |
| 3 | phosphoric acid salt | polyvinyl alcohol | 48 |
| 4 | rust proof film | polyvinyl alcohol + sodium polyacrylate | 480 |
| 5 | rust proof film | methyl cellulose | 192 |
| 6 | rust proof film | hydroxyethyl cellulose | 206 |
| 7 | chromate | polyvinyl alcohol + sodium polyacrylate | 432 |

TABLE 1-continued

| Ex. No. | Conversion Treatment | Water Repellnt Treatment | W.R.T. (hr.) |
|---|---|---|---|
| 8 | phosphoric acid salt | polyvinyl alcohol + sodium polyacrylate | 72 |
| 1* | rust proof film | None | 144 |
| 2* | chromate | None | 240 |
| 3* | phosphoric acid salt | None | not more than 12 |

1*~3*: comparative examples

What is claimed is:

1. A composition for water-repellent treatment of zinc and zinc alloys consisting essentially of 0.1 to 10% by weight of a non-ionic polymeric compound having both hydrophilic and hydrophobic groups in the molecule, a polyacrylic acid salt and a balance of water, wherein said composition has a pH of 6–8.

2. The composition of claim 1 wherein the non-ionic polymeric compound is selected from the group consisting of polyvinyl alcohol, methyl cellulose and hydroxyethyl cellulose.

3. The composition of claim 1 wherein the non-ionic polymeric compound is polyvinyl alcohol which has a degree of saponification ranging from 70 to 80 mole %.

4. The composition of claim 1 wherein the amount of the polyacrylic acid salt is 0.01 to 10% by weight.

5. A composition for water-repellent treatment of zinc and zinc alloys consisting essentially of a non-ionic polymeric compound having both hydrophilic and hydrophobic groups in the molecule selected from the group consisting of polyvinyl alcohol, methyl cellulose, ethyl cellulose, hydroxymethyl cellulose, hydroxyethyl cellulose and hydroxypropyl cellulose, a polyacrylic acid salt and a balance of water, the pH of the composition being 6 to 8.

6. The composition of claim 5 wherein amounts of the non-ionic polymeric compound and the polyacylic acid salt are 0.1 to 10% by weight and 0.01 to 10% by weight, respectively.

7. The composition of claim 1, wherein said non-ionic polymeric compound is polyvinyl alcohol.

* * * * *